US008622128B2

(12) United States Patent
Hegeman

(10) Patent No.: US 8,622,128 B2
(45) Date of Patent: Jan. 7, 2014

(54) IN-SITU EVALUATION OF RESERVOIR SANDING AND FINES MIGRATION AND RELATED COMPLETION, LIFT AND SURFACE FACILITIES DESIGN

(75) Inventor: Peter S Hegeman, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 973 days.

(21) Appl. No.: 12/511,008

(22) Filed: Jul. 28, 2009

(65) Prior Publication Data

US 2010/0258304 A1 Oct. 14, 2010

Related U.S. Application Data

(60) Provisional application No. 61/168,222, filed on Apr. 10, 2009.

(51) Int. Cl.
*E21B 47/00* (2012.01)

(52) U.S. Cl.
USPC ..... 166/250.01; 166/264; 166/66; 73/152.18; 73/152.23; 175/50; 175/58

(58) Field of Classification Search
USPC ..... 166/250.01, 264, 66; 175/50, 58; 73/152.18, 152.23; 405/223.1
See application file for complete search history.

(56) References Cited

U.S. PATENT DOCUMENTS

| | | | | |
|---|---|---|---|---|
| 3,384,181 | A | 5/1968 | Maly et al. | |
| 4,860,581 | A | 8/1989 | Zimmerman et al. | |
| 4,936,139 | A | 6/1990 | Zimmerman et al. | |
| 5,147,149 | A * | 9/1992 | Craig et al. | 405/223.1 |
| 5,443,119 | A | 8/1995 | Chambers et al. | |
| 6,672,163 | B2 | 1/2004 | Han et al. | |
| 7,181,380 | B2 | 2/2007 | Dusterhoft et al. | |
| 2006/0142955 | A1 | 6/2006 | Jones et al. | |
| 2007/0047867 | A1 * | 3/2007 | Goldner | 385/12 |
| 2008/0066534 | A1 * | 3/2008 | Reid et al. | 73/152.11 |
| 2008/0066537 | A1 | 3/2008 | Hegeman et al. | |
| 2010/0326654 | A1 * | 12/2010 | Hemblade | 166/250.01 |

FOREIGN PATENT DOCUMENTS

EP 1021710 9/2006

OTHER PUBLICATIONS

Wehunt, C.D., "Well Performance With Operating Limits Under Reservoir and Completion Uncertainties", SPE Drilling & Completion, Sep. 2006, pp. 200-211.

D. Gardner, T. Fallet, F. Nyhavn, "Production Logging Tool Developments for Horizontal Wells and Hostile Environments," SPE 36564, Oct. 6, 1996, pp. 793-803.

(Continued)

*Primary Examiner* — Yong-Suk (Philip) Ro
(74) *Attorney, Agent, or Firm* — Matthias Abrell; Jody DeStephanis; Tim Curington

(57) ABSTRACT

Methods and related systems are described relating to monitoring particulates downhole at in-situ conditions. Solid particles being carried in the fluid as the fluid is produced from the reservoir formation are monitored. The downhole solid particle monitoring can include measuring the quantity (e.g., volume fraction, weight fraction, or the like) of solid particles, measuring the distribution of sizes of the solid particles, and/or measuring the shape of the particles. The solid particles can be monitored using one or more of sensors such as optical spectrometers, acoustic sensors, video cameras, and erosion probes. A sanding prediction is generated based at least in part on the monitoring of the solid particles, and the sanding prediction is then used to design a completion, lift system, and surface facilities for the wellbore and/or select operating conditions so as to control sanding during production.

40 Claims, 11 Drawing Sheets

(56) References Cited

OTHER PUBLICATIONS

M.A. Addis et al. "Sand Quantification: The Impact on Sandface Completion Selection and Design, Facilities Design and Risk Evaluation," paper SPE 116713 presented at the 2008 SPE Annual Technical Conference and Exhibition, Denver, Colorado, Sep. 21-24.
Morita, N., and Boyd, P.A.: "Typical Sand Production Problems: Case Studies and Strategies for Sand Control," paper SPE 22739 presented at the 1991 SPE Annual Technical Conference and Exhibition, Dallas, Texas, Oct. 6-9.
Palmer, I., Vaziri, H., Willson, S., Moschovidis, Z., Cameron, J., and Ispas, I.: "Predicting and Managing Sand Production: A New Strategy," paper SPE 84499 presented at the 2003 SPE Annual Technical Conference and Exhibition, Denver, Colorado, Oct. 5-8.
Farrow, C., Munro, D., and McCarthy, T.: "Screening Methodology for Downhole Sand Control Selection," paper SPE 88493 presented at the 2004 SPE Asia Pacific Oil and Gas Conference and Exhibition, Perth, Australia, Oct. 18-20.
Oyeneyin, M.B., Peden, J.M., Hosseini, A., and Ren, G.: "Factors to Consider in the Effective Management and Control of Fines Migration in High Permeability Sands," paper SPE 30112 presented at the 1995 SPE European Formation Damage Conference, The Hague, The Netherlands, May 15-16.
McPhee, C., Farrow, C., and McCurdy, P.: "Challenging Convention in Sand Control: Southern North Sea Examples," SPE Production & Operations, May 2007, vol. 22, No. 2, 223-230.
Constien, V.G., and Skidmore, V.: "Standalone Screen Selection Using Performance Mastercurves," paper SPE 98363 presented at the 2006 SPE International Symposium and Exhibition on Formation Damage Control, Lafayette, Louisiana, Feb. 15-17.
Badry, R., Fincher, D., Mullins, O., Schroeder, B., and Smits, T.: "Downhole Optical Analysis of Formation Fluids," Oilfield Review 6, No. 1 (Jan. 1994), 21-28.
Tague, J.R., and Hollman, G.F.: "Downhole Video: A Cost/Benefit Analysis," paper SPE 62522 presented at the 2000 SPE/AAPG Western Regional Meeting, Long Beach, California, Jun. 19-23.
Drakeley, B.K., Johansen, E.S., Zisk, E.J., and Bostik, F.X. III: "In-Well Optical Sensing—State-of-the-Art Applications and Future Direction for Increasing Value in Production-Optimization Systems," paper SPE 99696 presented at the 2006 SPE Intelligent Energy Conference and Exhibition, Amsterdam, The Netherlands, Apr. 11-13.
Stuivenwold, P.A., and Mast, H.: "New Instrumentation for Managing Sand-Problem Prone Fields," paper SPE 9368 presented at the 1980 SPE Annual Technical Conference and Exhibition, Dallas, Texas, Sep. 21-24.
FracTech Laboratories (http://www.fractech.co.uk/consortiaPEA135.htm1; accessed Nov. 18, 2007).
Desroches, J., and Kurkjian, A.L.: "Applications of Wireline Stress Measurements," SPE Reservoir Evaluation & Engineering, Oct. 1999, vol. 2, No. 5, 451-461.
Blauch, M., Weaver, J., Parker, M., Todd, B., Glover, M.: "New Insights Into Proppant-Pack Damage Due to Infiltration of Formation Fines," paper SPE 56833 presented at the 1999 SPE Annual Technical Conference and Exhibition, Houston, Texas, Oct. 3-6.
Ramirez, M., Zdenkovic, N., and Medina, E.: "Technical/Economic Evaluation of Artificial Lift Systems for Eight Offshore Reservoirs," paper SPE 59026 presented at the 2000 SPE International Petroleum Conference and Exhibition, Villahermosa, Mexico, Feb. 1-3.
Brown, K.: "Overview of Artificial Lift Systems," Journal of Petroleum Technology, Oct. 1982, vol. 34, No. 10, 2384-2396.
Hirschfeldt, M., Martinez, P., and Distel, F.: "Artificial-Lift Systems Overview and Evolution in a Mature Basin: Case Study of Golfo San Jorge," paper SPE 108054 presented at the 2007 SPE Latin American and Caribbean Petroleum Engineering Conference, Buenos Aires, Argentina, Apr. 15-18.
Stair, C.C.D.:"Artificial Lift Design for the Deepwater Gulf of Mexico," paper SPE 48933 presented at the 1998 SPE Annual Technical Conference and Exhibition, New Orleans, Louisiana, Sep. 27-30.

* cited by examiner

Optical Density
0
1
2
3
4
5
600
900
1200
1500
1800
2100
Optical Spectrometer Wavelength (nanometer)
Medium-weight crude oil with solid particles
Medium-weight crude oil with no solid particles
412
410

IN-SITU EVALUATION OF RESERVOIR SANDING AND FINES MIGRATION AND RELATED COMPLETION, LIFT AND SURFACE FACILITIES DESIGN

CROSS-REFERENCE TO RELATED APPLICATIONS

This patent application claims benefit of Provisional Patent Application Ser. No. 61/168,222 filed on Apr. 10, 2009, which is incorporated by reference herein.

BACKGROUND OF THE INVENTION

1. Field of the Invention

This patent specification generally relates to downhole fluid analysis and in-situ formation evaluation. More particularly, this patent specification relates to in-situ evaluations of reservoir sanding and fines migrations.

2. Background of the Invention

The design of the completion of a producing well is a complex process that uses multiple sources of reservoir information. Similarly, the design of the production system, including artificial lift and surface facilities, relies on such information. A common problem for many wells is the tendency to produce solid particles from the reservoir formation, such as sand grains, fine particles, and the like. The production of solid particles is usually termed "sanding", although the particles need not be sand; for example, a carbonate reservoir that produces solid particles is said to produce "sand". Known methods for predicting sanding potential include using a stress-based mechanical model of the formation. Important inputs to such models are pore pressure, stress conditions, rock strength, and rock material properties. Rock material properties include grain sorting, shape, and size distribution.

The rock material properties are typically determined from mechanical testing on reservoir core samples. The tests are conducted at a surface laboratory. However, once a core is extracted from underground, it is impossible to restore it to exactly the same stress state as existed in the reservoir. Furthermore, it is possible for the core sample to undergo irreversible changes before it can be tested, including total collapse of the core. Although techniques exist for in-situ measurement of rock properties, these are limited mainly to measuring stress conditions. M. A. Addis et al. discuss a "Sand Influx Test" in which sand is deliberately produced from the reservoir; see "Sand Quantification: The Impact on Sandface Completion Selection and Design, Facilities Design and Risk Evaluation," paper SPE 116713 presented at the 2008 SPE Annual Technical Conference and Exhibition, Denver, Colo., September 21-24, hereinafter referred to as "Addis (2008)", which is incorporated by reference herein. However, this test requires sand to be produced to the surface, where all monitoring takes place. There is no guarantee that all the sand produced by the reservoir will flow to the surface. In fact, in most cases some portion of the produced sand flowing from the reservoir falls back into the well before it reaches the surface, making the test results unreliable. In addition, because all monitoring is at the surface (which is many thousands of feet away from the reservoir), there is a lengthy and unquantifiable time delay between what happens downhole and what is monitored at the surface. Furthermore, since all the control is performed at the surface, the range of flow rates and pressure drawdowns is limited. There are currently no methods for in-situ measurement of rock material properties such as grain sorting, shape, and size distribution, or measurement of the sanding potential of a reservoir formation. The lack of this information impacts the ability to design an optimal well completion, lift system, and surface facilities.

SUMMARY OF THE INVENTION

According to embodiments, a system for making measurements relating to particulates downhole at in-situ conditions is provided. The system includes a tool body adapted to be deployed in a borehole formed within a fluid containing subterranean formation, and a particulate measurement system housed within the tool body and adapted and positioned to monitor solid particles being carried in the fluid as the fluid is produced from the formation. The solid particle monitoring can include measuring downhole the quantity (e.g., volume fraction, weight fraction, or the like) of solid particles within the produced fluid, measuring downhole the distribution of sizes of the solid particles within the produced fluid, and/or measuring downhole the shape of the particles within the produced fluid. The solid particles can be monitored using one or more of sensors such as optical spectrometers, acoustic sensors, video cameras, and erosion probes. A processing system can generate a sanding prediction based at least in part on the monitoring of the solid particles in the produced fluid.

According to embodiments a method for making downhole in-situ evaluations relating to particulates is provided. The method includes deploying a tool body in the wellbore formed within a fluid containing subterranean formation; drawing the fluid from the formation into the tool body; and monitoring solid particles being carried in the fluid as the fluid is produced from the formation. According to some embodiments, a sanding prediction is generated based at least in part on the monitoring of the solid particles, and the sanding prediction is then used to design a completion, lift system, and surface facilities for the well and/or select operating conditions so as to control sanding during production.

Further features and advantages of the invention will become more readily apparent from the following detailed description when taken in conjunction with the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PREFERRED EMBODIMENTS

Figure 1:
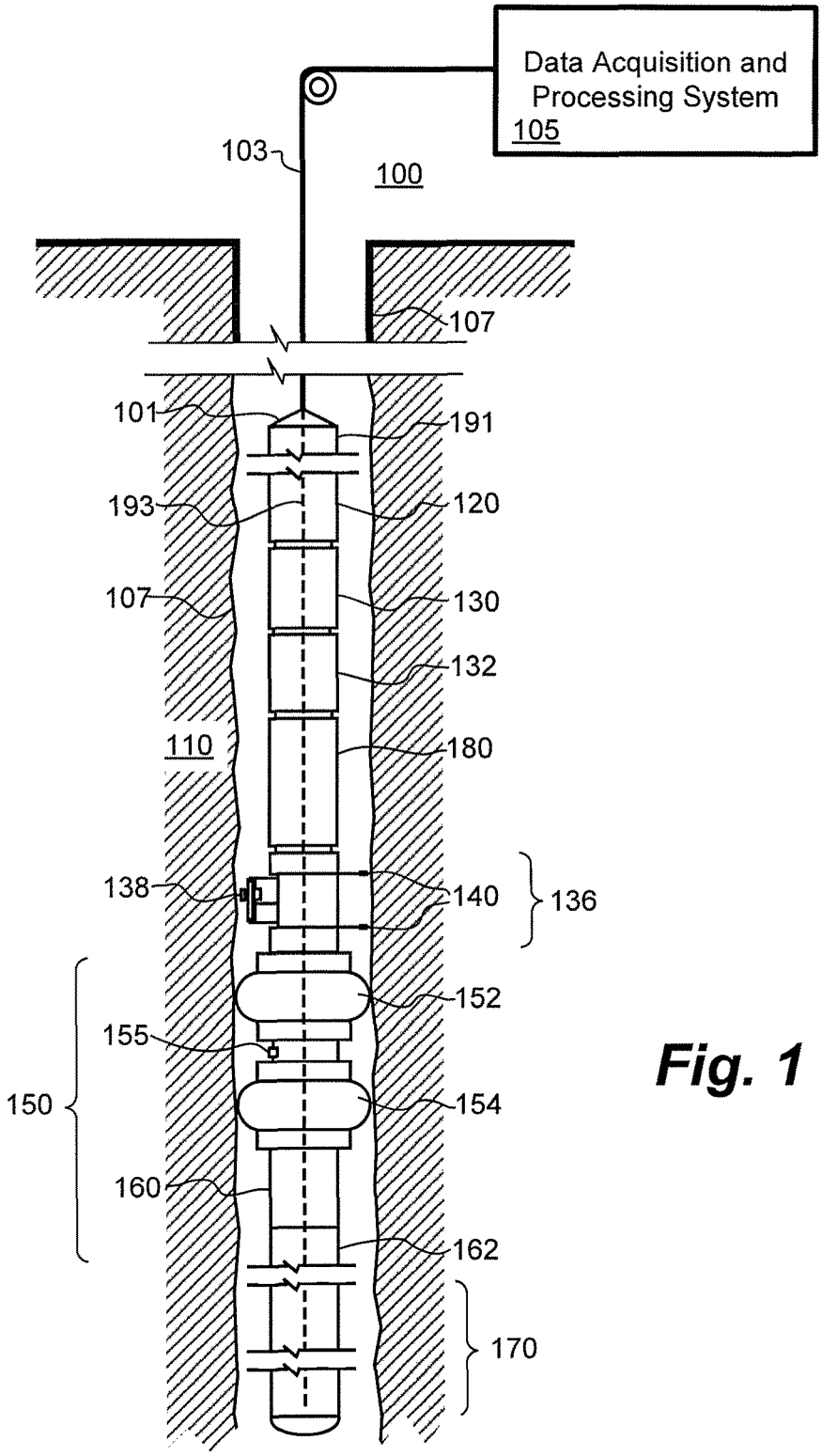
FIG. 1 shows a downhole system for analyzing particulates in-situ with a formation testing tool, according to embodiments.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. Further, like reference numbers and designations in the various drawings indicated like elements.

This patent specification generally relates to the field of downhole fluid analysis and in-situ formation evaluation. According to some embodiments, these activities are practiced during a formation test. According to some other embodiments, the analysis is performed as part of a well test (e.g., drillstem test; production test), production logging operation, or any other operation where reservoir fluids can be evaluated at downhole conditions.

In recent years, downhole fluid characterization techniques, including contamination monitoring, composition measurement, and single-phase assurance, have provided real-time fluid property information during formation testing. Downhole fluid analysis helps ensure that representative samples are obtained, and allows an unlimited number of zones to be evaluated in a "fluid scanning" mode. An important benefit of downhole fluid analysis is that the reservoir fluid is characterized at in-situ conditions. This eliminates the risk that by the time a captured sample arrives at a surface laboratory, the sample is no longer representative (due to leaks, irreversible changes caused by changing temperature, etc.). According to some embodiments, an in-situ particulate evaluation system is provided that is analogous to downhole fluid analysis.

According to some embodiments, a process is provided for determining optimal design of the completion, lift system, and surface facilities for a well based on in-situ evaluation of reservoir sanding and fines migration. The process uses the in-situ analysis of rock material properties such as grain sorting, shape, and size distribution, and a test procedure to measure the sanding potential of a formation as a function of drawdown pressure.

The most typical sand production problems are found in poorly-consolidated formations. Formations having poor cementation will usually produce sand if the effective in-situ stress exceeds the formation strength. For further information, see Morita, N., and Boyd, P. A.: "Typical Sand Production Problems: Case Studies and Strategies for Sand Control," paper SPE 22739 presented at the 1991 SPE Annual Technical Conference and Exhibition, Dallas, Tex., October 6-9 (hereinafter referred to as "Morita (1991)"), which is incorporated by reference herein. However, sand failure does not always cause sand production; failed sand can remain stable due to capillary forces holding the particles together. See Palmer, I., Vaziri, H., Willson, S., Moschovidis, Z., Cameron, J., and Ispas, I.: "Predicting and Managing Sand Production: A New Strategy," paper SPE 84499 presented at the 2003 SPE Annual Technical Conference and Exhibition, Denver, Colo., October 5-8 (hereinafter referred to as "Palmer (2003)"), incorporated by reference herein. Following water breakthrough, there is a loss of capillary force and sand production will often begin. For further information, see Morita (1991); Farrow, C., Munro, D., and McCarthy, T.: "Screening Methodology for Downhole Sand Control Selection," paper SPE 88493 presented at the 2004 SPE Asia Pacific Oil and Gas Conference and Exhibition, Perth, Australia, October 18-20 (hereinafter referred to as "Farrow (2004)"); and Oyeneyin, M. B., Peden, J. M., Hosseini, A., and Ren, G.: "Factors to Consider in the Effective Management and Control of Fines Migration in High Permeability Sands," paper SPE 30112 presented at the 1995 SPE European Formation Damage Conference, The Hague, The Netherlands, May 15-16 (hereinafter referred to as "Oyeneyin (1995)"), each of which is incorporated by reference herein. The volume of sand produced from a poorly-consolidated formation may reach 10 to 20% of the total fluid production, resulting in sand-up within a few days. See, e.g. Morita (1991).

According to some embodiments, systems and methods for predicting sanding potential and the effects of sand production on the reservoir, completion, lift system, and surface facilities are provided. The onset of sanding can be predicted using a stress-based model of shear failure around a perforation or an openhole wellbore. One common input to the model is data from a thick-walled cylinder test (TWC) obtained from cores; a second input is unconfined compressive strength (UCS), which can be measured from cores or can be predicted from wireline logs. An estimation of whether the produced sand will be carried to the surface or if it will accumulate in the wellbore can be made by estimating the drag force the fluid will have on the sand particles, which in-turn relies on the particle size being known. See, e.g. Palmer (2003). Erosion modeling can be used in deciding whether downhole sand control needs to be applied. See, e.g. McPhee, C., Farrow, C., and McCurdy, P.: "Challenging Convention in Sand Control: Southern North Sea Examples," *SPE Production & Operations*, May 2007, Volume 22, Number 2, 223-230 (hereinafter referred to as "McPhee (2007)"), which is incorporated herein by reference. Particle size distribution is also important; it is not enough to know only the average particle size of the reservoir sand. Formation sand grain sorting, shape (well-rounded vs. angular), size, and size distribution should be obtained. See, e.g. Oyeneyin (1995). Particle size information can be determined from core samples. See, e.g. Farrow (2004); and Constien, V. G., and Skidmore, V.: "Standalone Screen Selection Using Performance Mastercurves," paper SPE 98363 presented at the 2006 SPE International Symposium and Exhibition on Formation Damage Control, Lafayette, La., February 15-17, which is incorporated by reference herein. However, according to embodiments, as is described in further detail below, particle size information is analyzed in-situ downhole.

FIG. 1 shows a downhole system for analyzing particulates in-situ with a formation testing tool, according to embodiments. Wireline logging system 100 is shown including multiple tools containing sensors for taking geophysical measurements. Wireline 103 is a power and data transmission cable that connects the tools to a data acquisition and processing system 105 on the surface. The tools connected to the wireline 103 are lowered into an uncased section of well borehole 107 to obtain measurements of geophysical properties for the surrounding subterranean rock formation 110. The wireline 103 supports tools by supplying power to the tool string 101. Furthermore, the wireline 103 provides a communication medium to send signals to the tools and to receive data from the tools.

The tools, sometimes referred to as modules, are typically connected via a tool bus 193 to telemetry unit 191 which in turn connects to the wireline 103 for receiving and transmitting data and control signals between the tools and the surface data acquisition and processing system 105. Commonly, the tools are lowered to a particular depth of interest in the borehole and are then retrieved by the data acquisition and processing system 105. For sampling and testing operations a tool such as Schlumberger's Modular Formation Dynamics Tester tool (MDT) tool may be used. The tool is positioned at the desired location and data are collected while the tool is stationary. The data are sent via wireline 103 to data acquisition and processing system 105 at the surface, usually contained inside a logging truck or logging unit (not shown).

Electronic power module 120 converts AC power from the surface to provide DC power for all modules in the tool string 101. Pumpout module 130 is used to pump unwanted fluid, for example mud filtrate, from the formation to the borehole via a flowline within the modules (not shown), so that representative samples can be taken from formation 110. Pumpout module 130 can also be used to pump fluid from the borehole into the flowline for inflating packers in a module containing inflatable packers. Pumpout module 130 can also be configured to transfer fluid from one part of the tool string to another via the flowline. Hydraulic module 132 contains an electric motor and hydraulic pump to provide hydraulic power as may be needed by certain modules.

Single-probe module 136 contains a selectively extendable fluid admitting probe assembly 138 having a packer, and telescoping backup pistons 140 which are selectively extendable for anchoring and are arranged on opposite sides of the tool body. The probe assembly 138 is configured to selectively seal off or isolate selected portions of the wall of the wellbore to fluidly couple the adjacent formation 110 and draw fluid samples from the formation 110. Also included is a fluid analysis module 180 through which the obtained fluid samples can flow. The fluid may thereafter be expelled through a port (not shown) or it may be sent to one or more sample chamber units 170, which may receive and retain the formation fluid for subsequent testing at the surface or a testing facility. Module 136 may also contain pressure gauges, fluid resistivity, and temperature sensors, and a pretest chamber (not shown). Examples of a fluid sampling system using probes and packers are depicted in U.S. Pat. Nos. 4,936,139 and 4,860,581, which are incorporated by reference herein.

Dual-packer module 150 includes an upper inflatable packer element 152, lower packer element 154, valve body 160 and electronics 162. Inflatable packer elements 152 and 154 seal against the borehole wall 107 to isolate an interval of the borehole. Pumpout Module 130 inflates the packers with wellbore fluid. Inlet 155 is provided to draw fluid from the packer interval to the interior of the tool body. The length of the test interval (i.e., the distance between the packers) is about 3.2 ft (0.98 m) and can be extended by inserting spacers between the packer elements. The area of the isolated interval of the borehole is many orders of magnitude larger than the area of the borehole wall isolated by a probe such as probe 138. For fluid sampling, the large area results in flowing pressures that are only slightly below the reservoir pressure, which avoids or reduces phase separation for pressure-sensitive fluids such as gas condensates or volatile oils. In low-permeability formations, high pressure drop (drawdown) usually occurs with the probe, whereas the fluid can be withdrawn from the formation using the dual-packer module 150 with minimum pressure drop through the larger flowing area. Dual-packer module 150 can also be used to create a micro-hydraulic fracture that can be pressure tested to determine the minimum in-situ stress magnitude. The fracture is created by pumping wellbore fluid into the interval between the inflatable packer elements. Below dual-packer module 150 are one or more sample chamber units 170 for holding fluid samples collected downhole. Although in FIG. 1 both a single-probe module 138 and a dual-packer module 150 are shown, in practice, according to some embodiments one or the other could be used alone in toolstring 101.

In the illustrated example, the data acquisition and processing system 105 and/or a downhole control system housed within tool string 101 are configured to control either the single-probe assembly 136 or dual-packet module 150 to draw fluid samples from the formation 110 and to control the fluid analysis module 180 to measure the fluid samples. In some example implementations, the fluid analysis module 180 may be configured to analyze the measurement data of the fluid samples as described herein. In other example implementations, the fluid analysis module 180 may be configured to generate and store the measurement data and subsequently communicate the measurement data to the surface for subsequent analysis at the surface. Note that the downhole control system can be implemented separate from the modules 136 and 150, or in some example implementations, the downhole control system may be implemented in the modules 136 and 150.

Although the components of FIG. 1 are shown and described above as being communicatively coupled and arranged in a particular configuration, the components of the tool string 101 can be communicatively coupled and/or arranged differently than depicted in FIG. 1 without departing from the scope of the present disclosure. In addition, the example methods described herein are not limited to a particular conveyance type but, instead, may be implemented in connection with different conveyance types including, for example, coiled tubing, wireline, wired-drill-pipe, and/or other conveyance means known in the industry.

Figure 2A:
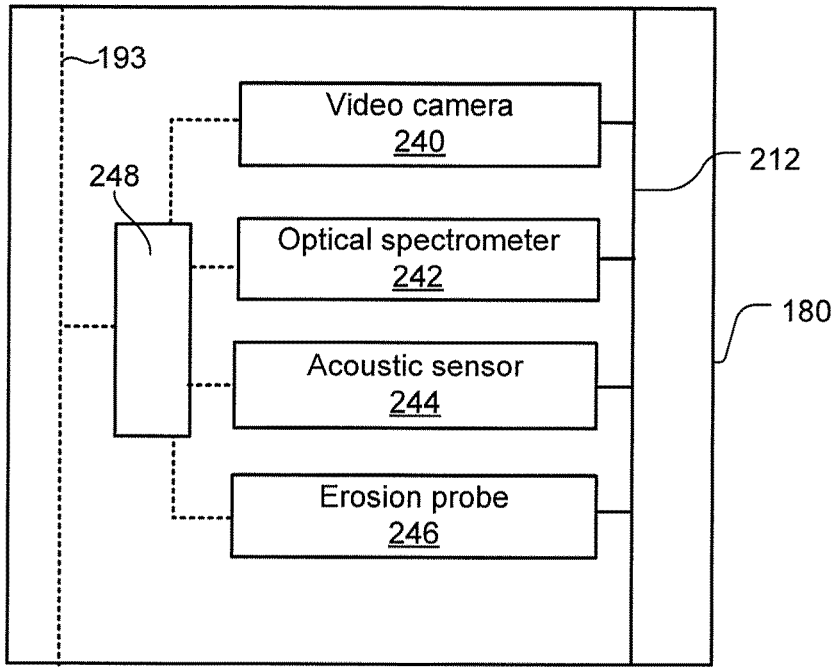
FIGS. 2*a-e* show further detail of a fluid analysis module for in-situ particulate analysis, according to embodiments.

FIGS. 2*a-e* show farther detail of a fluid analysis module for in-situ particulate analysis, according to embodiments. In FIG. 2*a*, fluid analysis module 180 includes various types of measurement systems such as video camera 240, optical spectrometer 242, acoustic sensor 244 and erosion probe 246. Each of the types of measurement systems can be used to collect particulate information on the fluid flowing in flowline 212. Processing unit 248 is used to control the measurement systems and also to collect, store and process data from the measurement systems. Unit 248 is also connected to tool bus 193 so as to enable control and communication of data to with the surface and other parts of the tool string. By providing the ability to control the tool and measurement process downhole, the reservoir can be tested at a much wider range of flow rates and pressure drawdowns than can be achieved with surface control. Although four types of measurement systems are shown as part of module 180, in practice any number or combination of measurement systems can be used.

Figure 2B:
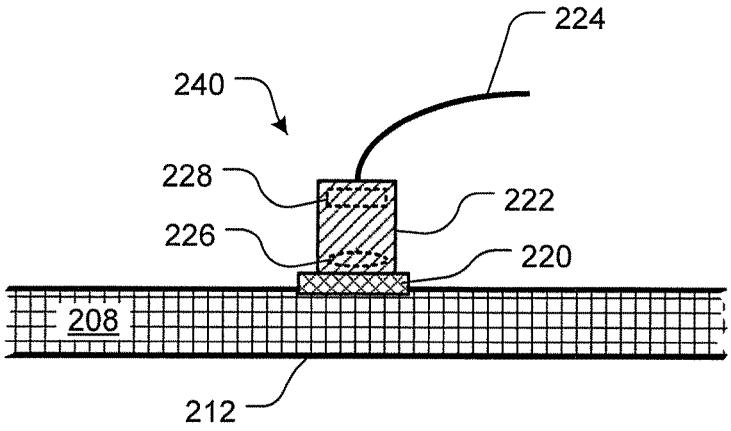

FIG. 2*b* shows further detail of a video camera measurement system 240, according to some embodiments. The camera 222 includes a lens 226 and lighting source 228 (for example, LED's). The light source 228 is positioned at the top of the camera 222 to provide backlighting. The window 220 on flowline 212 has a non-reflective coating. According to some embodiments, window 220 is made from sapphire. The camera 222 can be controlled and programmed to take single-shot images or continuous video, or both of the formation fluid 208 flowing in flowline 212. Electrical and/or fiber optic connection lines 224 are used to control the camera 222 and to transmit electronic and/or optical information from camera 222.

Figure 2C:
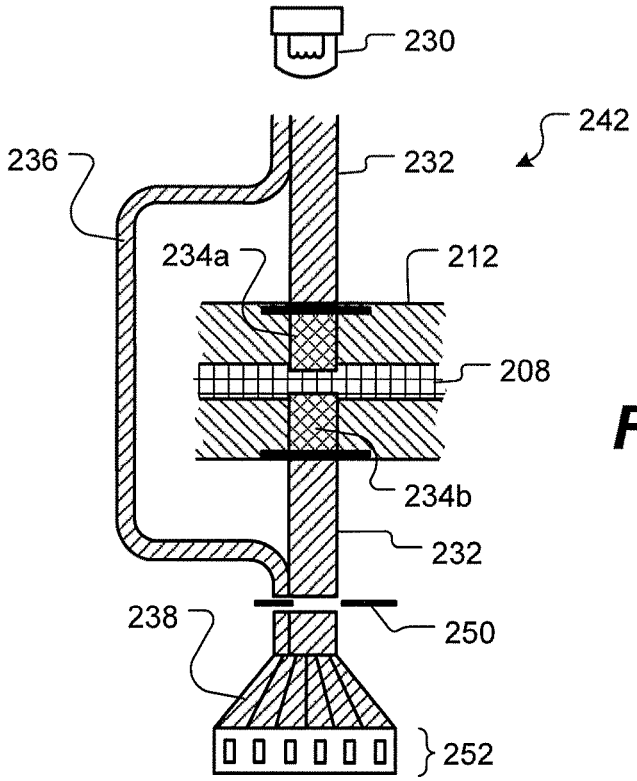

FIG. 2*c* shows farther detail of an optical spectroscopy measurement system 242, according to some embodiments. Light from a tungsten halogen lamp 230 is directed along either of two paths. One path, source path 236 is used for downhole calibration, while the other path, measure path 232 directs the light to the flowline 212 for measurement. Light passes through the formation fluid 208 within flowline 212 by way of sapphire windows 234*a* and 234*b* and shutter 250 to a spectral distributor 238 where photodiode detectors 252, each tuned to a different wavelength, measure the transmission intensity. The system 242 can provide measurements in the ultraviolet, visible, and near infrared wavelength regions. For further details on downhole optical analysis of formation fluids, see Badry, R., Fincher, D., Mullins, O., Schroeder, B., and Smits, T.: "Downhole Optical Analysis of Formation Fluids," Oilfield Review 6, no. 1 (January 1994), 21-28, which is incorporated herein by reference.

Figure 2D:
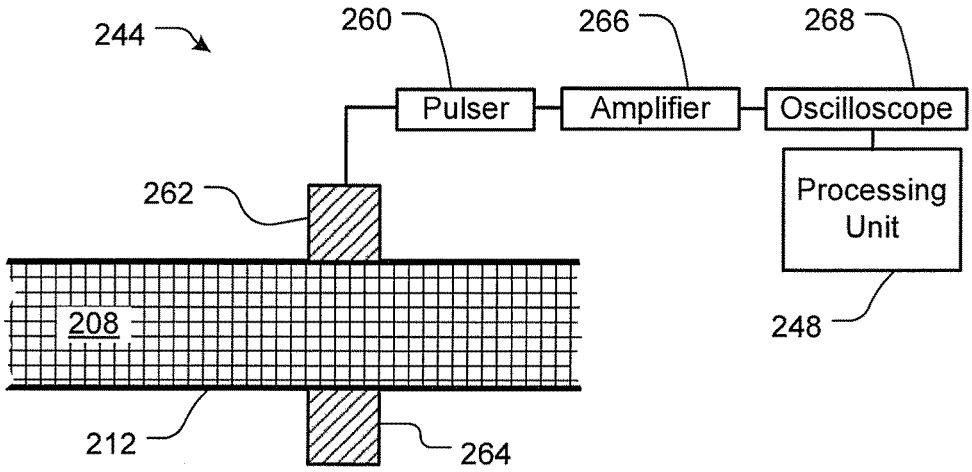

FIG. 2*d* shows further detail of an acoustic measurement system 244, according to some embodiments. A pulse generator or pulser 260 generates an electrical signal which is transmitted to an acoustic probe 262 that transforms the electrical signal into an acoustic signal that is transmitted into the formation fluid 208 flowing in flowline 212. The same probe 262 or optionally a separate acoustic sensor 264, detects an "echo" of the acoustic signal, which is caused by scattering of the signal as it encounters sand particles in the fluid 208. An amplifier 266 amplifies the detected scattered signal and transmits the amplified signal to an oscilloscope 268 which converts the signal from analog to digital, selects that part of the detected scattered signal that results from scattering in the focal region of the probe (which selection step is termed "gating"), and transforms the amplitude vs. frequency distribution. This distribution is transmitted to processing unit 248 that compares the distribution with a standard and thereby detecting, determining, or otherwise quantifying particle size of the sand in formation fluid 208. For further details on a downhole acoustic measurement system as applied to asphaltenes, see European Patent Specification EP 102171018, which is incorporated herein by reference.

Figure 2E:
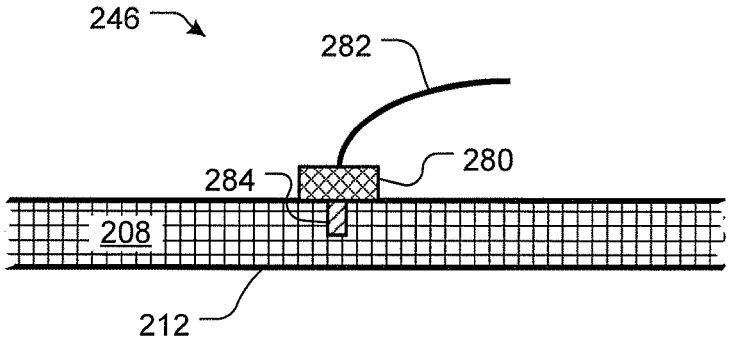

FIG. 2*e* shows further detail of an erosion probe 246, according to some embodiments. The probe is based on the electrical resistance principle, where metal loss on the metal-covered probe 284 is measured by electronics 280 as increased electrical resistance. The metal loss is caused by sand erosion. That is, as the sand particles in formation fluid 208 flowing in flowline 212 erode the metal on probe 284, the resistance increases as the metal loss increases. Electronics 280 is controlled by and transmits data via connection 282. Sand production rates can be quantified by combining measured metal loss rates with average sand particle size and flow data. According to some embodiments, the probe 284 is made of corrosion-resistant materials so that sand erosion can be distinguished from corrosion due to acidic fluids, hydrogen sulphide, etc.

Figure 3A:
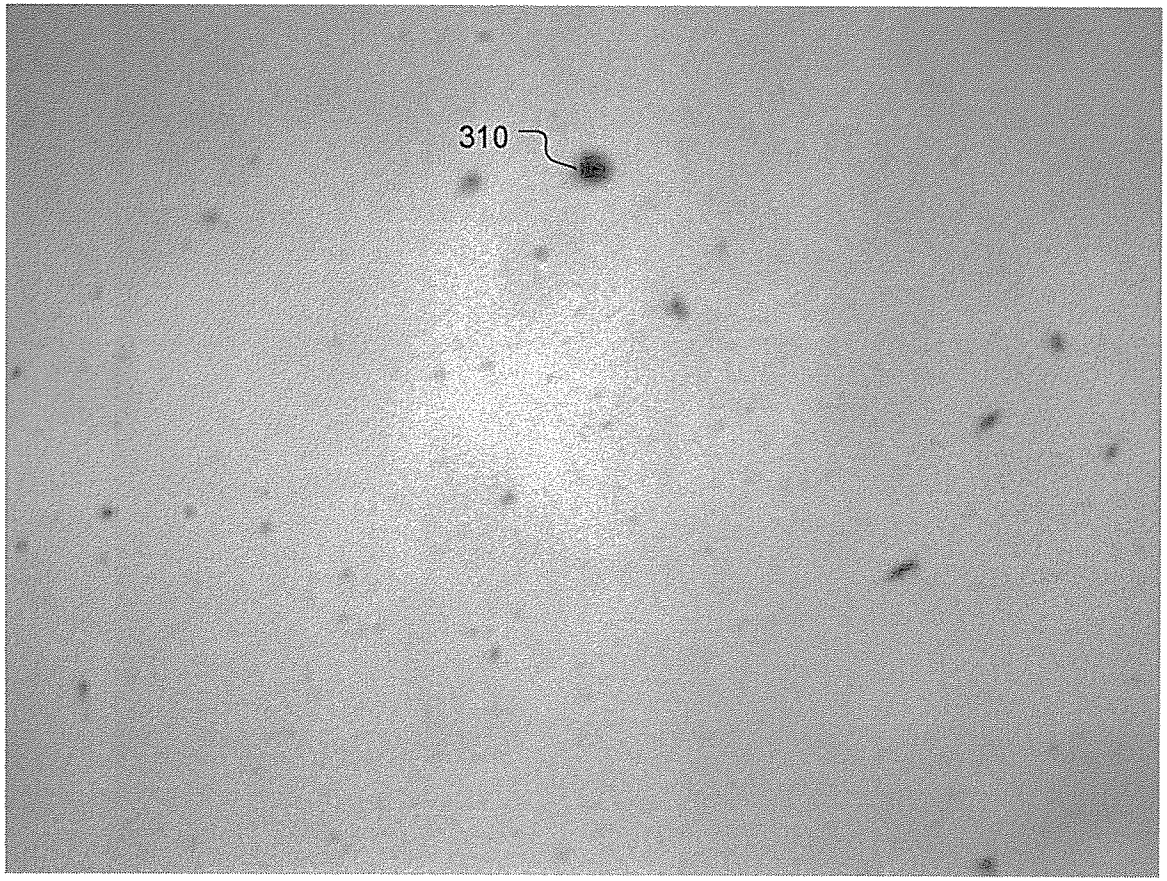
FIGS. 3*a* and 3*b* illustrate downhole video images used to identify the production of sand, according to some embodiments.
Figure 3B:
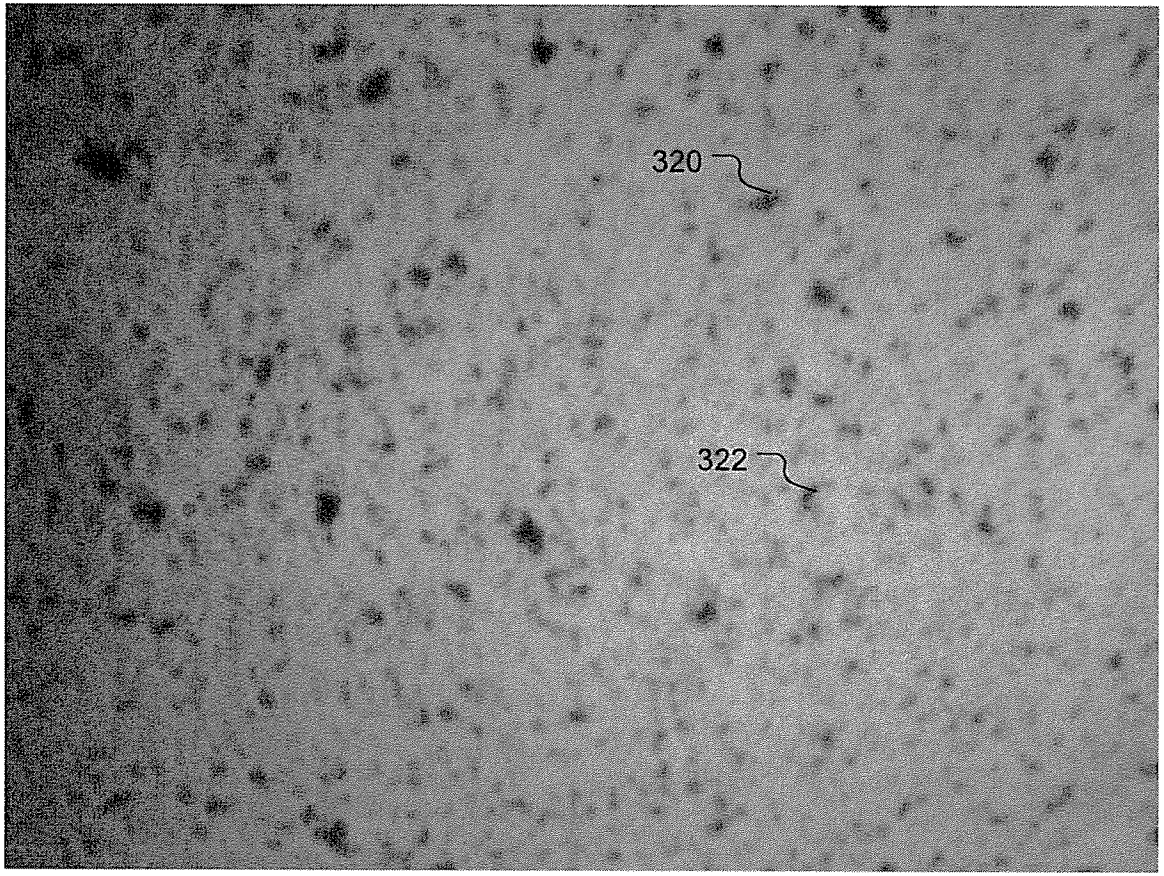

FIGS. 3*a* and 3*b* illustrate downhole video images as would be obtained by video camera 240 as shown in FIGS. 2*a* and 2*b*, used to identify the production of sand, according to some embodiments. In FIG. 3*a*, there is almost no production of solid particles, which are identified as the dark spots such a spot 310. As the flowing pressure is lowered at the wellbore, the formation produces a significant amount of solid particles such as dark spots 320 and 322, as shown in the FIG. 3*b*. An image analysis of pictures such as FIGS. 3*a* and 3*b* provides an estimate of the quantity of solids being produced, as well as the distribution of the size and shape of the solid particles.

Figure 4:
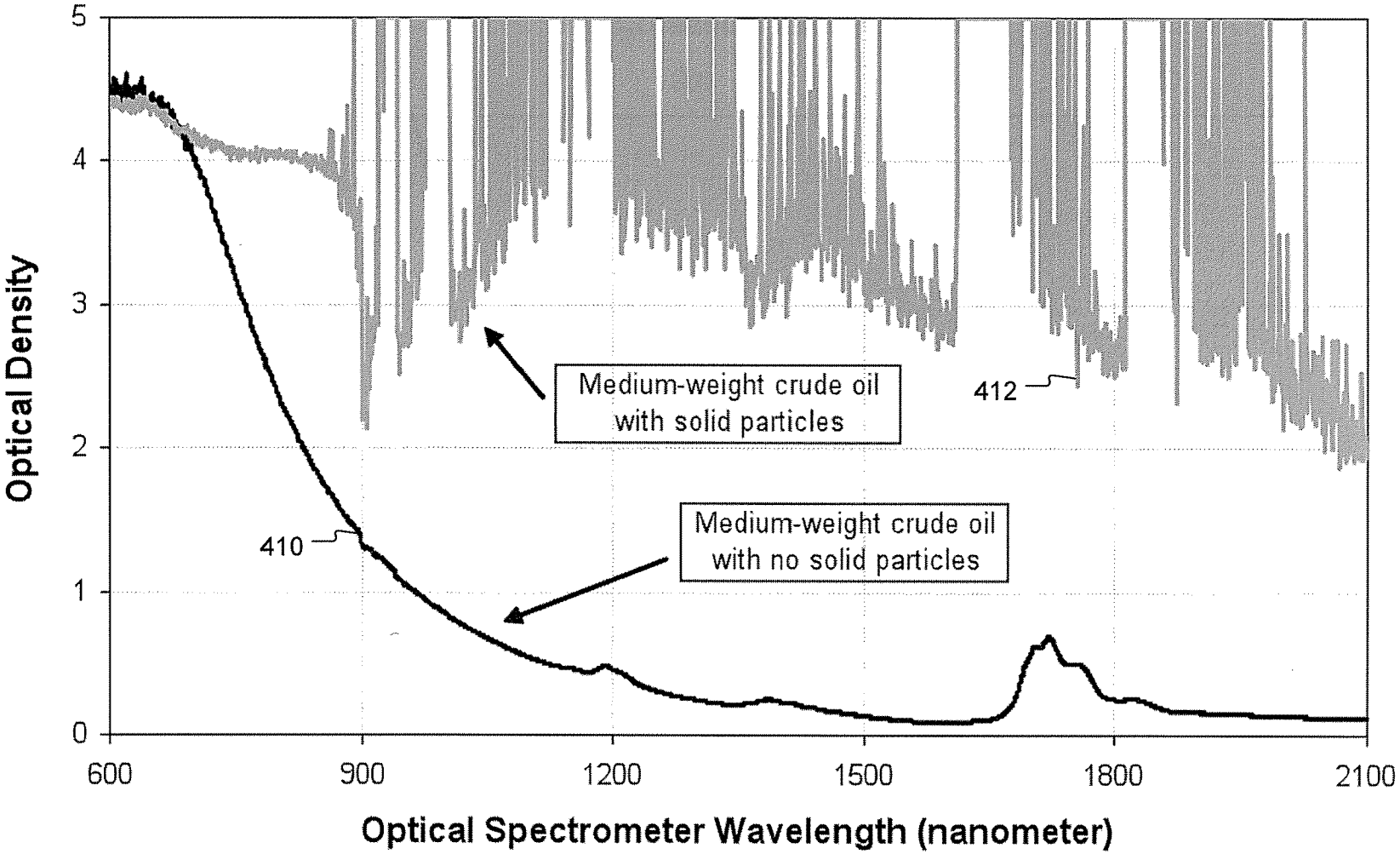
FIG. 4 is a plot showing optical density versus optical spectrometer wavelength, according to some embodiments.

FIG. 4 is a plot showing optical density versus optical spectrometer wavelength, according to some embodiments. FIG. 4 shows that a downhole optical spectrometer, such as optical spectrometer 242 in FIG. 2*a*, can be used to identify the production of sand. Curve 410 shows the optical spectrum (i.e., plot of optical density vs. wavelength) of a medium-weight crude oil that contains no solid particles. Curve 412 shows the optical spectrum of the same fluid containing solid particles. This fluid exhibits "optical scattering", which is an increase in the value of optical density due to the effect of the solid particles scattering the optical spectrometer light. Note that the amount of scattering (i.e., difference curve 410 and curve 412) is not a constant. This is due to the fact that the solid particles are not all the same size and shape, so the amount of scattering will be different for each wavelength of the light. For further implementation details, refer to U.S. Patent Application U.S.2008/0066537, published Mar. 20, 2008, incorporated herein by reference, which describes an analogous case of scattering due to an emulsion.

Optical density is a unitless measure of light transmittance as described by equation 1:

$$OD = -\log\frac{I}{I_0} \qquad \text{(Eq. 1)}$$

where OD is optical density, I is the intensity of the transmitted light, and $I_0$ is the intensity of incident light in the optical spectrometer. An optical density of zero indicates that no light is absorbed (i.e., 100% is transmitted), an optical density of 1.0 indicates that 10% of the light is transmitted through the sample, an optical density of 2.0 indicates that 1% of the light is transmitted through the sample, etc.

Figure 5:
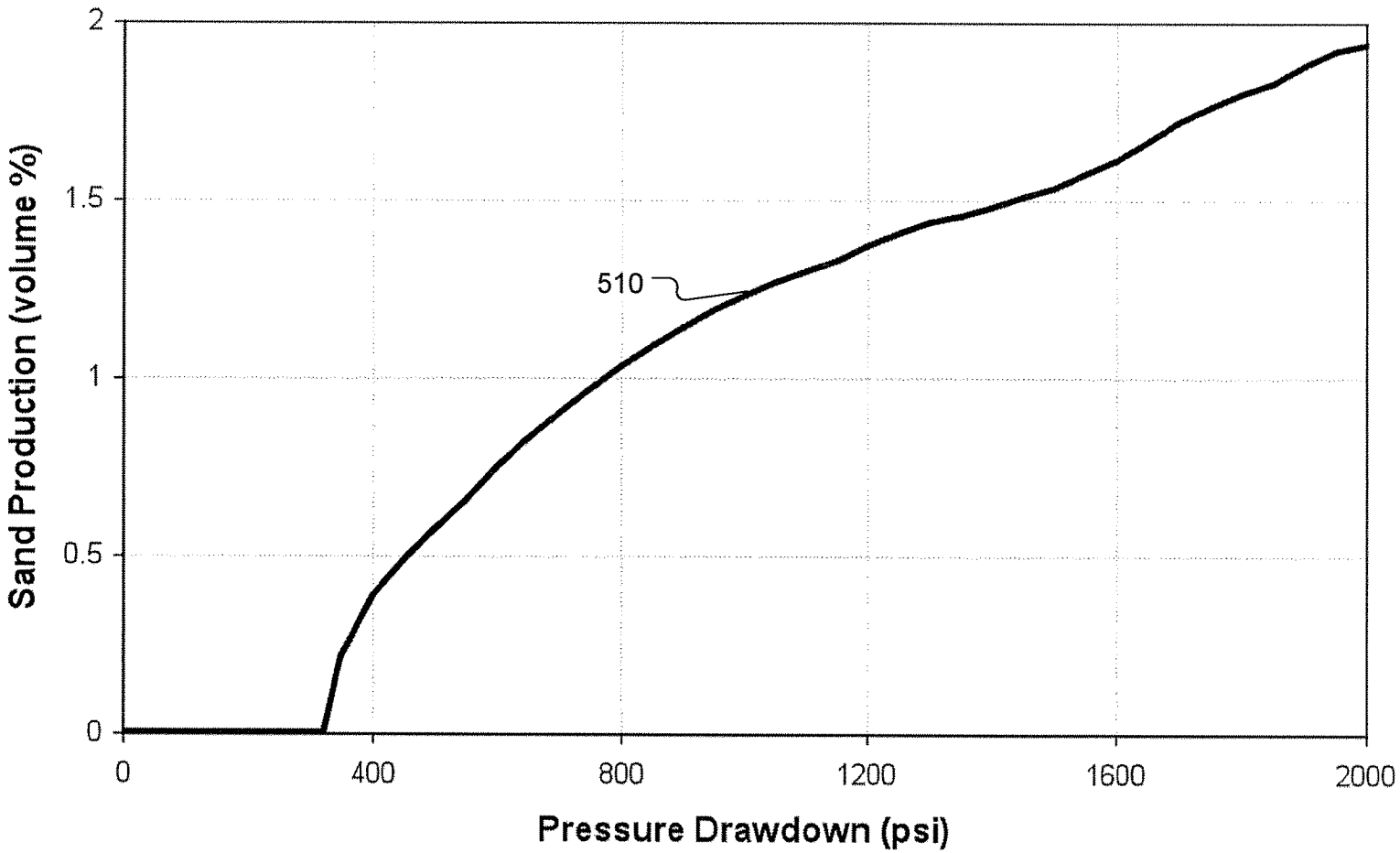
FIG. 5 shows results obtained from an in-situ test to measure the sand production as a function of pressure drawdown, according to some embodiments.

FIG. 5 shows results obtained from an in-situ test to measure the sand production as a function of pressure drawdown, using a tool such as shown in FIG. 1, according to some embodiments. The term "pressure drawdown" refers to the difference between static reservoir pressure and the flowing pressure at the wellbore. This example curve 510 shows a reservoir that produces sand-free until a critical drawdown pressure of approximately 350 psi. At this point sand production commences, and increasingly larger amounts of sand are produced as the pressure drawdown increases (i.e., as the flowing pressure at the wellbore is reduced by increasing the pump rate).

Figure 6:
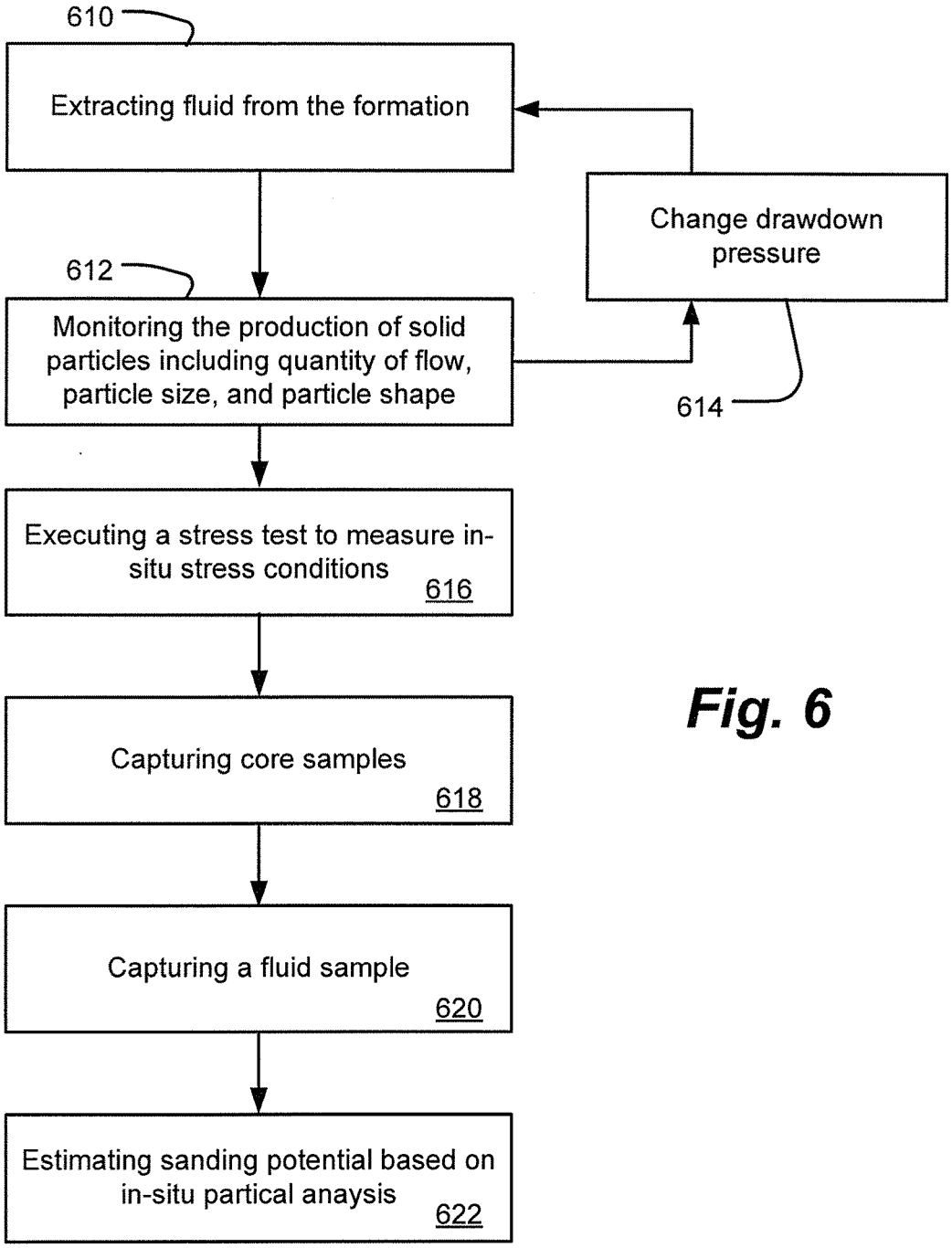
FIG. 6 is a flow chart showing steps associated with measuring at in-situ conditions the sanding potential of an underground formation, according to some embodiments.

FIG. 6 is a flow chart showing steps associated with measuring at in-situ conditions the sanding potential of an underground formation, according to some embodiments. In step 610 fluid is extracted from the reservoir formation (e.g., pumping out with a formation testing tool). In step 612, the production of solid particles from the reservoir, including the amount of solid particle flow, particle size distribution, and particle shape are monitored (qualitatively & quantitatively). According to some embodiments, in step 614 the drawdown pressure is changed and steps 610 and 612 are repeated. In this way, the production of solid particles can be monitored at varying levels of pressure drawdown, so as to determine sanding potential as a function of drawdown. In step 616, according to some embodiments, a stress test is conducted to measure in-situ stress conditions. For example, a dual-packer wireline tool such as shown and described with respect to FIG. 1 can be used to inject fluid into the formation thereby initiating cracking of rock in the formation, while monitoring the injection rate and pressure. In step 618, according to some embodiments, a core sample is captured that can be used for surface laboratory measurements. For example, a core sample can be obtained using a tool such as Schlumberger's Mechanical Sidewall Coring Tool (MSCT). The MSCT cuts cores from the borehole wall using a miniature synthetic diamond rotary coring bit. The rotary action of the coring bit does not impact the formation; therefore, petrophysical parameters are not altered and high quality cores are retrieved. In step 620, according to some embodiments, a fluid sample is captured that can be analyzed at a surface laboratory for solids content, particle size distribution, etc.

As is described in greater detail below, the described monitoring of the production of solid particles from the reservoir can be preformed using any one/combination of sensors, such as optical spectrometers, acoustic sensors, video cameras, and erosion probes.

As described above, according to some embodiments, a video camera is used downhole to gather particle information. For further details on the use of a video camera for the detection of fluid and sand entry, see Tague, J. R., and Hollman, G. F.: "Downhole Video: A Cost/Benefit Analysis," paper SPE 62522 presented at the 2000 SPE/AAPG Western Regional Meeting, Long Beach, Calif., June 19-23, which is incorporated by reference herein. Further information can be obtained from Jones, C. M. and Elrod, L. W.: "In Situ Optical Computation Fluid Analysis System and Method," United States patent application, US 2006/0142955 A1, published Jun. 29, 2006, incorporated by reference herein, which states that optics can be used to detect solid particles and solid types in crude petroleum; and from Drakeley, B. K., Johansen, E. S., Zisk, E. J., and Bostik, F. X. III: "In-Well Optical Sensing-State-of-the-Art Applications and Future Direction for Increasing Value in Production-Optimization Systems," paper SPE 99696 presented at the 2006 SPE Intelligent Energy Conference and Exhibition, Amsterdam, The Netherlands, April 11-13, incorporated by reference herein, which suggests that based on optical flow meters the technology has the promise in detecting sand production.

According to some further embodiments, an acoustic sensor can be used to gather particulate information in-situ. For example, see Stuivenwold, P. A., and Mast, H.: "New Instrumentation for Managing Sand-Problem Prone Fields," paper SPE 9368 presented at the 1980 SPE Annual Technical Conference and Exhibition, Dallas, Tex., September 21-24, incorporated by reference herein, which discusses a detector based on a steel sensor that incorporate a piezo-electric transducer which was developed to monitor sand production at surface or downhole. The acoustic impact of a sand grain impinging on the sensor rod deforms the piezo crystal, which produces an electrical signal. For quantitative sand production data, the tool should be calibrated; grain size distribution affects the results. Impact energy is recorded; this provides an indication of grain size distribution because impact energy is a function of mass and velocity of the particles. Further, in designing a tool, it should be considered that this type of acoustic sensor is not particularly well suited to noisy environments, such as multiphase flow.

According to some embodiments, acoustic measurements of scattering of acoustic energy is used to detect, determine, and otherwise quantify particle size of sand. For further details, see European Patent Specification EP 1021710, which is incorporated by reference herein, which discusses a method for measuring the agglomeration state of asphaltenes in oil. The method involves applying to the oil a signal of acoustic energy, which gets scattered by the asphaltenes; the scattered energy is detected at various frequencies. In U.S. Pat. No. 6,672,163, which is incorporated by reference herein, a method and apparatus are discussed that uses acoustic transducers to detect and identify gas bubbles, solid particles, and/or liquid droplets in fluids. According to some further embodiments, one or more erosion probes are used to monitor sand production. See, e.g. McPhee (2007).

As described above, according to some embodiments, a core sample is taken downhole to aid in the sanding prediction estimation. Various rock mechanical testing methods can be used on reservoir core for sand production prediction, including unconfined compressive strength (UCS) testing, confirmed strength testing (CST), and thick-walled cylinder (TWC) testing. See, FracTech Laboratories (http://www.fractech.co.uk/consortiaPEA135.html; accessed Nov. 18, 2007), which is incorporated by reference herein. In using these techniques, it should be noted that these testing methods can exhibit the following drawbacks: (1) UCS method: the core will exhibit a lower strength than it would in the reservoir and will be susceptible to failure along the bedding planes; (2) CST method: the test will produce a stress-strain curve from the reservoir core; however, it may not be clear at which point this curve will intersect with the onset of sanding; and (3) TWC method: the onset of sanding usually occurs when the sidewall fails; this produces over-conservative results and makes it necessary to apply a sanding factor.

As described above, according to some embodiments, a stress test can be executed to measure in-situ stress conditions. For further information, see Desroches, J., and Kurkjian, A. L.: "Applications of Wireline Stress Measurements," *SPE Reservoir Evaluation & Engineering*, October 1999, Volume 2, Number 5, 451-461, incorporated by reference herein, which discusses applications of wireline stress measurements based on microhydraulic fracturing and packer fracturing techniques. Reliable measurements can be obtained of the minimum horizontal stress and the maximum horizontal stress in a near-vertical openhole well, and tests can be conducted in a eased-hole environment.

According to some embodiments, techniques for determining optimal or improved design of the completion, lift system, and surface facilities are provided. The techniques preferably make use of estimates of sanding potential that rely on in-situ particulate evaluations as described elsewhere herein. The predicted sanding information is used to model the expected performance of various completion/production systems. According to some embodiments, the predicted sanding information is also used to select appropriate hardware and operating conditions. Thus, a method for controlling sanding potential is provided which comprises measuring at in-situ conditions the sanding potential of an underground formation and then, acting to control sanding potential through installation of hardware and/or selection of operating conditions (flow rate, pressure, etc.).

When sand production is predicted or expected, according to embodiments, various methods can be used for its management and control. The use of screens and gravel packs at the sandface/wellbore interface can reduce or eliminate sand production. See, e.g. Oyeneyin (1995). For soft formations, frac-packing can be used to control sand influx to the wellbore. See, e.g. Blauch, M., Weaver, J., Parker, M., Todd, B., Glover, M.: "New Insights Into Proppant-Pack Damage Due to Infiltration of Formation Fines," paper SPE 56833 presented at the 1999 SPE Annual Technical Conference and Exhibition, Houston, Tex., October 3-6 (hereinafter referred to as "Blauch (1999)"), which is incorporated by reference herein. However, in designing a completion it has to be considered that these methods can get plugged and/or damaged by sand and fine particles. In Blauch (1999) "micro fines" is defined as particle size of 1 to 20 micrometers, and "macro fines" as being larger than 20 micrometers. Solids migration can often be reduced by proper perforating (penetration; entrance hole, etc.). See, e.g. Oyeneyin (1995). In some cases it may be best to do sand control at the surface, and have no downhole restriction to sand production. See, e.g. Farrow (2004).

For further information on the optimal selection of a hydrocarbon well completion, see U.S. Pat. No. 7,181,380, which is incorporated by reference herein. Material modeling (using input of stress state information) can be used to predict rock failure, and the mechanism of failure; such models can be used for sand production prediction. There are various completion options based on the planned strategy to manage sand production.

According to embodiments, further detail of the impact of sand production on artificial lift systems will now be provided. Very few wells will flow naturally throughout their entire life; as reservoir pressure declines, artificial lift is usually required to augment the energy of the reservoir. According to embodiments, the sanding potential based on particulate measurements at in-situ conditions is used to develop an effective artificial lift plan. The artificial lift plan, additionally is based on other technical as well as economic factors, and a thorough risk analysis. For further information, see Ramirez, M., Zdenkovic, N., and Medina, E.: "Technical/Economic Evaluation of Artificial Lift Systems for Eight Offshore Reservoirs," paper SPE 59026 presented at the 2000 SPE International Petroleum Conference and Exhibition, Villahermosa, Mexico, February 1-3, which is incorporated by reference herein. Of all the artificial lift systems, only gas lift can handle a large volume of solids with only minor problems; this is because only gas lift does not require the sand-laden fluid to pass through the lifting mechanism. See, Brown, K.: "Overview of Artificial Lift Systems," *Journal of Petroleum Technology*, October 1982, Volume 34, Number 10, 23842396, which is incorporated by reference herein. Downhole pumps, properly equipped, can handle sand; useful modifications include self-lubricating plungers, ring valves or "sand valves", and two-stage hollow valve rod pumps. The severity of sand abrasion depends on a number of factors: quantity of sand, acid solubility, particle size distribution, quantity of quartz, and particle geometry (angularity). Hydraulic jet pumps are a solution for wells producing with a high percentage of sand where other means of sand control cannot be used. See, Hirschfeldt, M., Martinez, P., and Distel, F.: "Artificial-Lift Systems Overview and Evolution in a Mature Basin: Case Study of Golfo San Jorge," paper SPE 108054 presented at the 2007 SPE Latin American and Caribbean Petroleum Engineering Conference, Buenos Aires, Argentina, April 15-18, which is incorporated by reference herein. In deepwater Gulf of Mexico the artificial lift system choices are only gas lift and electric submersible pumps. See, Stair, C. D.: "Artificial Lift Design for the Deepwater Gulf of Mexico," paper SPE 48933 presented at the 1998 SPE Annual Technical Conference and Exhibition, New Orleans, La., September 27-30, which is incorporated by reference herein.

Figure 7:
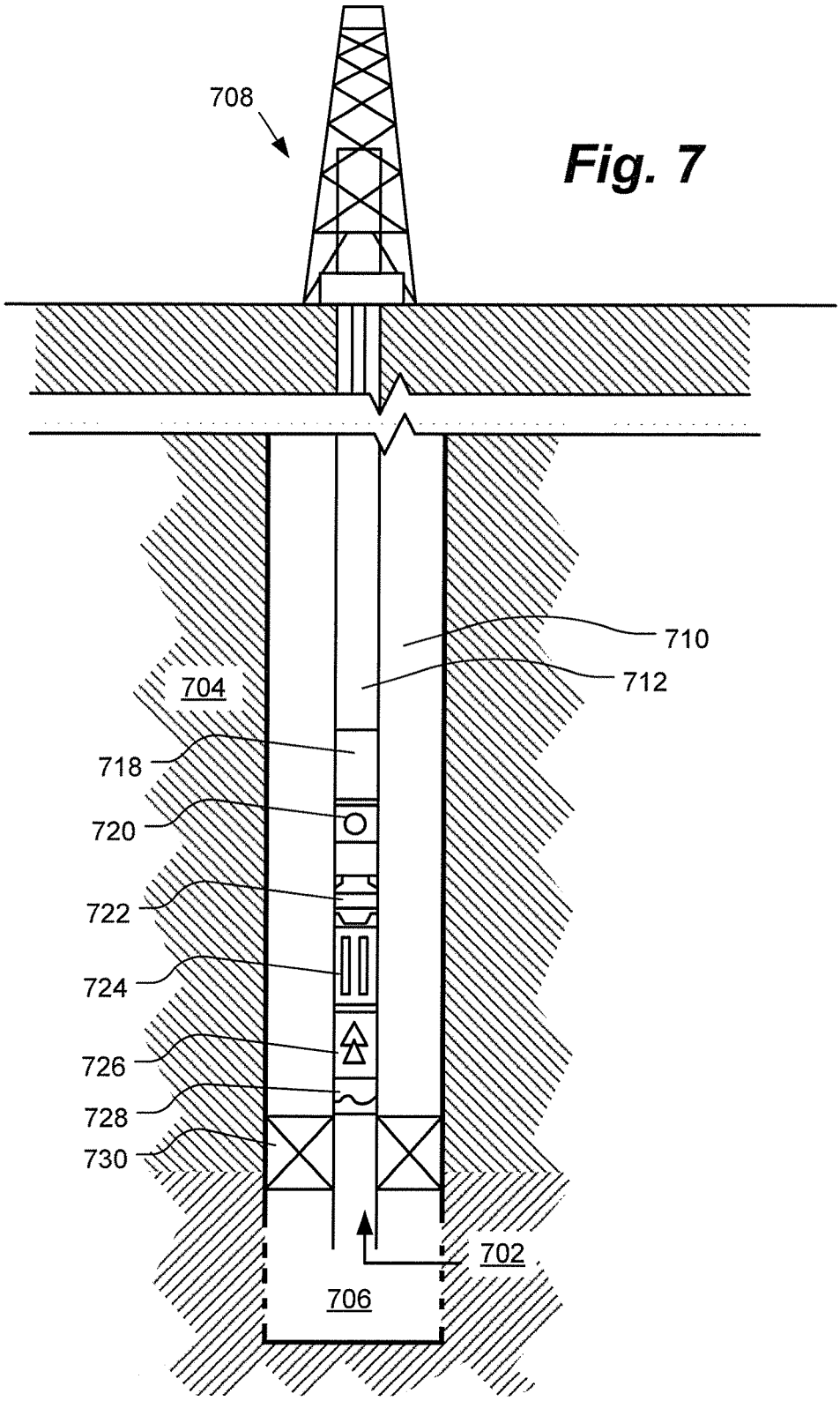
FIG. 7 shows portions of a drillstem testing system that is used to make particulate measurements at in-situ conditions, according to some embodiments.

Although the measurements of particulate properties at in-situ conditions have so far been described in the context of using a wireline sampling tool such as Schlumberger's Modular Formation Dynamics Tester tool (MDT), the invention is not so limited. According to some embodiments other types of downhole tools are used to make the described particulate measurements at in-situ conditions. For example, according to some embodiments a drillstem testing (DST) platform is used to make the particulate measurements at in-situ conditions. FIG. 7 shows portions of a DST system that is used to make particulate measurements at in-situ conditions, according to some embodiments. DST is a method of gathering data on the potential productivity of a reservoir before a permanent completion string is installed. The equipment for a DST includes a string 712 (tubing or drillpipe), a retrievable packer 730 and a tester valve 722, a reversing valve 720, jars 726, pressure and temperature gauge carrier 724, and safety joint 728. In operation the DST tool is deployed, via rig 708, in a cased or openhole borehole 710 made within the earth 704. In the case of a borehole that is cased, the lower section 706 of borehole 710 is perforated in the region of reservoir rock 702. According to embodiments, the DST tool also includes a fluid analysis module 718 that contains equipment used to make particulate measurements at in-situ conditions. The module 718 can contain any of the equipment of fluid analysis module 180 as shown and described in FIG. 2*a*, including a downhole video camera, optical spectrometer, acoustic sensor, and erosion probe. The string 712 channels the flow from reservoir 702 and borehole section 706 to the surface. The packer 730 is a rubber element used to isolate the zone 702 to be tested. The tester valve 722 provides a method of controlling the well near the reservoir. For example, the amount by which the tester valve 722 is opened can be used to control the pressure drawdown (i.e., the flowing pressure at the wellbore is reduced by increasing the amount by which the tester valve 722 is opened.)

Figure 8:
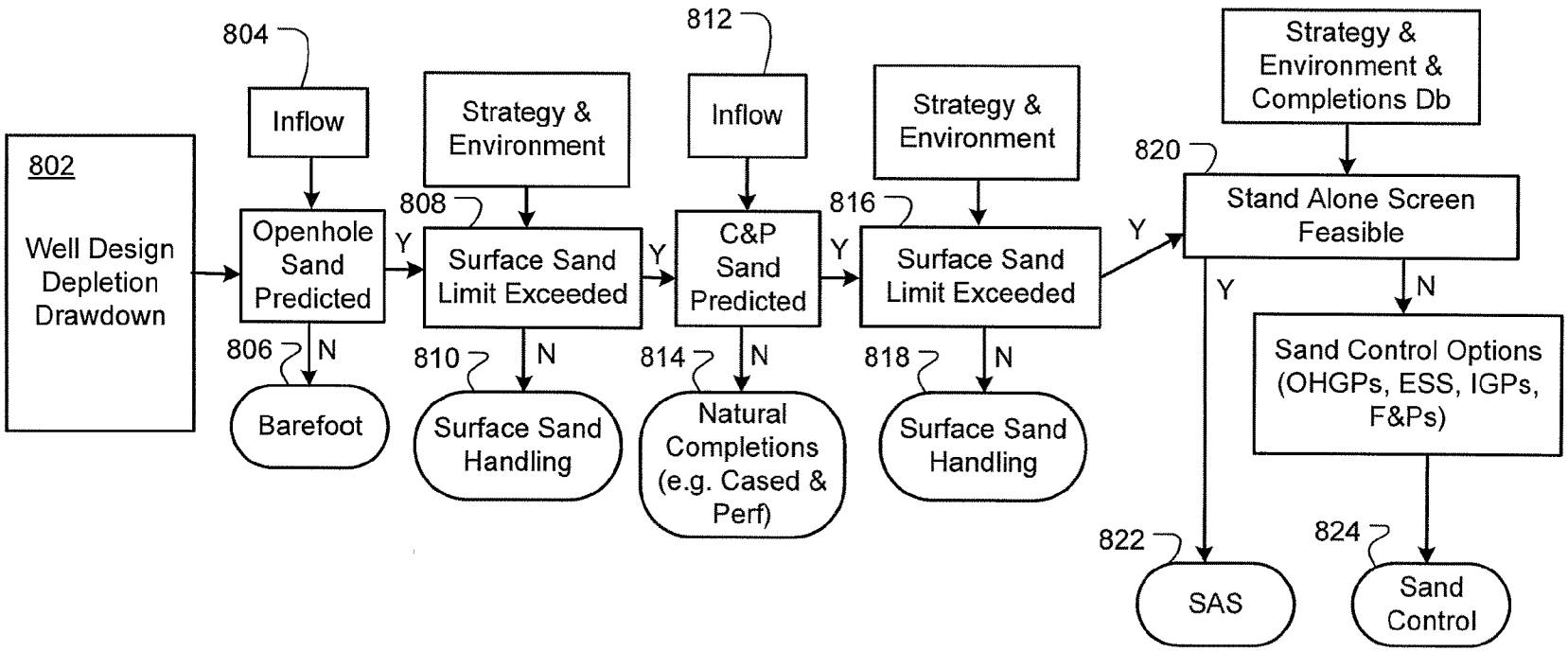
FIG. 8 is a flow chart showing decision logic for sandface completion, according to some embodiments.

FIG. 8 is a flow chart showing decision logic for sandface completion, according to some embodiments. For further detail on decision logic schemes, see Addis (2008). In step 802, various input data is provided, preferably including the following: (1) in-situ sanding evaluation data: quantity of "sand" (solid particles) production vs. pressure drawdown; distribution of sizes of the solid particles and shapes of the particles; (2) wellbore configuration (e.g., hole diameter, depth, deviation); (3) reservoir description (e.g., permeability, porosity, fluid type); and (4) expected range of operating conditions of the well (e.g., what flow rate is required for the well to be economic).

In step 804, the expected performance ("Inflow") is modeled for an openhole well completion ("Barefoot"). Then the question is asked—do the model results show that the reservoir will produce sand at the expected operating conditions? In step 806, if "no," then a "barefoot" completion is chosen (it is typically the most productive and lowest cost) and no surface facilities will be required to handle sand production. In step 808, if "yes," the model results show the reservoir will produce sand. Next, the question is asked—will the amount of produced sand exceed the capability of the current (or proposed) surface facilities, such as a sand separator or sand trap? In step 810, if "no," then the "barefoot" completion with current (or proposed) surface sand handling facilities is selected.

In step 812, if "yes," then a "barefoot" completion cannot be used. Next, model the expected performance ("Inflow") for a "natural completion" (i.e., the wellbore is cased, cemented, and then perforated). Then the question is asked—do the model results show that the reservoir will produce sand at the expected operating conditions? In step 814, if "no", then a "natural completion" is chosen and no surface facilities will be required to handle sand production. In step 816, if "yes", the model results show the reservoir will produce sand. Next, the question is asked—will the amount of produced sand exceed the capability of the current (or proposed) surface facilities, such as a sand separator or sand trap? In step 818, if "no", then the "natural completion" with current (or proposed) surface sand handling facilities is selected. In step 820, if "yes", then a "natural completion" cannot be used. Next, the expected performance is modeled for a Stand Alone Screen (SAS). Then the question is asked—is the SAS feasible (i.e., reservoir will not produce sand, or if it does, surface facilities can handle the sand produced)? In step 822, if "yes", the SAS is selected. In step 824, if "no", so a "sand control completion" must be selected. The choices include openhole gravel pack (OHGP), expandable sand screen (ESS), inside casing gravel pack (IGP) where no gravel is placed into the perforations, and fracture and pack with sand (F&P). Each method is modeled, and the one with optimum production (largest flow rate with least sand production) is selected.

Whereas many alterations and modifications of the present invention will no doubt become apparent to a person of ordinary skill in the art after having read the foregoing description, it is to be understood that the particular embodiments shown and described by way of illustration are in no way intended to be considered limiting. Further, the invention has been described with reference to particular preferred embodiments, but variations within the spirit and scope of the invention will occur to those skilled in the art. It is noted that the foregoing examples have been provided merely for the purpose of explanation and are in no way to be construed as limiting of the present invention. While the present invention has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A system for making measurements relating to particulates downhole at in-situ conditions comprising:

a tool body adapted to be deployed in a borehole formed within a fluid containing subterranean formation; and a particulate measurement system housed within the tool body during measurement and adapted and positioned to monitor solid particles being carried in the fluid as the fluid is produced from the formation, wherein said monitoring of the solid particles includes measuring quantity of the solid particles within the produced fluid, wherein said measuring quantity of solid particles includes measuring volume percent of the solid particles within the produced fluid or weight percent of the solid particles within the produced fluid.

2. The system according to claim 1 wherein said monitoring of the solid particles includes measuring the distribution of sizes of the solid particles within the produced fluid.

3. The system according to claim 1 further comprising a downhole pumping system housed within the tool body and adapted and positioned to generate a pressure differential between the formation and the inside of the tool body.

4. The system according to claim 3 wherein the measurement system and pumping system are adapted such that the solid particles are monitored at a plurality of different pressure differentials between the formation and the inside of the tool body.

5. The system according to claim 3 further comprising one or more extendable packer members that when extended can form a seal against the wall of the borehole and wherein the pumping system is adapted to increase the pressure in the formation in the vicinity of the seal to measure in-situ stress conditions within the formation.

6. The system according to claim 1 further comprising a core sampling system adapted and positioned to gather a core sample from the formation.

7. The system according to claim 1 further comprising a fluid sampling system housed within the tool body and adapted and positioned to gather a fluid sample from the formation.

8. The system according to claim 1 wherein the particulate measurement system includes one or more types of devices selected from the group consisting of: optical spectrometer, acoustic sensor, video camera, and erosion probe.

9. The system according to claim 1 wherein the tool body is suspended from a wireline cable.

10. The system according to claim 1 wherein the tool body is part of a drill string.

11. The system according to claim 10 wherein the particulate measurement system adapted such that the solid particles can be monitored as part of a drillstem test.

12. The system according to claim 1 further comprising a processing system adapted and programmed to generate a sanding prediction based at least in part on the monitoring of the solid particles in the produced fluid, wherein the sanding prediction includes sand weight percentage or volume percentage of the produced fluid, distribution of size of sand and shapes of sand.

13. The system according to claim 1 wherein the particulate measurement system comprises an optical spectrometer, an acoustic sensor, a video camera, and an erosion probe.

14. A system for making measurements relating to particulates downhole at in-situ conditions comprising:

a tool body adapted to be deployed in a borehole formed within a fluid containing subterranean formation; and a particulate measurement system housed within the tool body during measurement and adapted and positioned to monitor solid particles being carried in the fluid as the fluid is produced from the formation, wherein said monitoring of the solid particles includes measuring quantity of the solid particles within the produced fluid, wherein said monitoring of the solid particles includes measuring the shape of the solid particles within the produced fluid.

15. A method for making downhole in-situ evaluations relating to particulates comprising:

deploying a tool body in the wellbore formed within a fluid containing subterranean formation;

drawing the fluid from the formation into the tool body; and monitoring solid particles being carried in the fluid as the fluid is produced from the formation, wherein said monitoring of the solid particles includes measuring quantity of the solid particles within the produced fluid and wherein the monitoring is done by a particulate measurement system housed in the tool body, wherein said measuring quantity of solid particles includes measuring volume percent of the solid particles within the produced fluid or weight percent of the solid particles within the produced fluid.

16. The method according to claim 15 wherein said monitoring of the solid particles includes measuring the distribution of sizes of the solid particles within the produced fluid.

17. The method according to claim 15 wherein the fluid is drawn from the formation using a pumping system housed within the tool body that generates a pressure differential between the formation and the inside of the tool body.

18. The method according to claim 17 wherein the solid particles are monitored at a plurality of different pressure differential values.

19. The method according to claim 17 further comprising:
isolating a portion of the borehole using one or more extendable packer members;
increasing the pressure in the formation in the vicinity of the isolated portion of the borehole; and
measuring in-situ stress conditions within the formation.

20. The method according to claim 15 further comprising gathering a core sample from the formation.

21. The method according to claim 15 further comprising gathering a fluid sample from the formation.

22. The method according to claim 15 wherein the solid particles are monitored using one or more types of devices selected from the group consisting of: optical spectrometer, acoustic sensor, video camera, and erosion probe.

23. The method according to claim 15 wherein the tool body is deployed using a wireline cable.

24. The method according to claim 15 wherein the tool body is deployed using a drill string.

25. The method according to claim 24 wherein the solid particles are monitored as part of a drillstem test.

26. The method according to claim 15 further comprising generating a sanding prediction based at least in part on the monitoring of the solid particles in the produced fluid, wherein the sanding prediction includes sand weight percentage or volume percentage of the produced fluid, distribution of size of sand and shapes of sand.

27. The method according to claim 26 further comprising designing a completion for the wellbore based at least in part on the sanding prediction.

28. The method according to claim 26 further comprising selecting operating conditions so as to control sanding during production from the wellbore based at least in part on the sanding prediction.

29. The method according to claim 28 wherein the operating conditions includes one or more selected from the group consisting of: flow rate, drawdown pressure, and choke size.

30. The method according to claim 26 further comprising designing an artificial lift system for the wellbore based at least in part on the sanding prediction.

31. The method according to claim 30 wherein the artificial lift system is designed to use a technology selected from the group consisting of: gas lift system, sanding tolerant downhole pumps, and hydraulic jet pumps.

32. The method according to claim 26 further comprising designing surface facilities based at least in part on the sanding prediction.

33. A method for making downhole in-situ evaluations relating to particulates comprising:
deploying a tool body in the wellbore formed within a fluid containing subterranean formation;
drawing the fluid from the formation into the tool body; and
monitoring solid particles being carried in the fluid as the fluid is produced from the formation, wherein said monitoring of the solid particles includes measuring quantity of the solid particles within the produced fluid and wherein the monitoring is done by a particulate measurement system housed in the tool body,
wherein said monitoring of the solid particles includes measuring the shape of the solid particles within the produced fluid.

34. A method of designing a completion for a wellbore comprising selecting components for the completion system based at least in part on a sanding prediction generated using data of monitored solid particles being carried in a fluid produced from the wellbore gathered under in-situ conditions, wherein the data of monitored solid particles being carried in a fluid produced from the wellbore gathered under in-situ conditions comprises quantity of the solid particles within the produced fluid measured by a particulate measurement system housed in a tool body, wherein said quantity is volume percent or weight percent.

35. The method according to claim 34 wherein the sanding prediction is generated also using an analysis of a core sample from the formation.

36. The method according to claim 34 wherein the sanding prediction is generated also using an analysis of a fluid sample from the formation.

37. The method according to claim 34 wherein the solid particles are monitored using one or more downhole measurement selected from the group consisting of: particle shape measurements; particle size distribution measurements; and measurements of the quantity of solid particles within the produced fluid.

38. A method of controlling sanding potential for a wellbore comprising selecting operating conditions for producing fluid from the wellbore so as to control sanding, the selection being based at least in part on a sanding prediction generated using data of monitored solid particles being carried in a fluid produced from the wellbore gathered under in-situ conditions, wherein the solid particles are monitored using one or more downhole measurements selected from the group consisting of: particle shape measurements; and measurements of the quantity of solid particles within the produced fluid, wherein said quantity is volume percent or weight percent.

39. A method for making downhole in-situ evaluations relating to particulates comprising:
deploying a tool body in the wellbore formed within a fluid containing subterranean formation;
drawing the fluid from the formation into the tool body; and
monitoring solid particles being carried in the fluid as the fluid is produced from the formation, wherein said monitoring of the solid particles includes measuring quantity of the solid particles within the produced fluid and wherein the monitoring is done by a particulate measurement system housed in the tool body,
wherein said monitoring of the solid particles includes measuring the distribution of sizes of the solid particles within the produced fluid;
wherein said monitoring of the solid particles includes measuring the shape of the solid particles within the produced fluid;
the method further comprising:
executing a stress test to measure in-situ stress conditions;
capturing a core sample;
capturing a fluid sample; and
estimating sanding potential based on in-situ particle analysis.

40. A method for making downhole in-situ evaluations relating to particulates comprising:
deploying a tool body in the wellbore formed within a fluid containing subterranean formation;
drawing the fluid from the formation into the tool body; and
monitoring solid particles being carried in the fluid as the fluid is produced from the formation, wherein said monitoring of the solid particles includes measuring quantity of the solid particles within the produced fluid and wherein the monitoring is done by a particulate measurement system housed in the tool body,
the method further comprising generating a sanding prediction based at least in part on the monitoring of the solid particles in the produced fluid, wherein the sanding prediction includes sand weight percentage or volume percentage of the produced fluid, distribution of size of sand and shapes of sand, the method further comprising designing a completion for the wellbore based at least in part on the sanding prediction, wherein the designed well completion is an open hole completion as no sand production is predicted;

wherein the designed well completion includes natural completions as sanding is predicted and the reservoir is predicted not to produce sand;

wherein the designed well completion includes a surface sand handling facility as sanding is predicted and the reservoir is predicted to produce sand;

wherein the designed well completion includes a stand-alone-screen as the predicted sand production exceeds the capacity of the surface sand handling facility; and wherein the designed well completion includes a sand control device selected from a group consisting of open hole gravel pack, expandable sand screen, inside casing gravel pack, and fracture and pack with sand as the predicted sand production exceeds the capacity of stand-alone-screen.

* * * * *